United States Patent [19]

Matayoshi et al.

[11] Patent Number: 4,944,256

[45] Date of Patent: Jul. 31, 1990

[54] ROCKER ARM ARRANGEMENT FOR INTERNAL COMBUSTION ENGINE POPPET VALVES AND THE LIKE

[75] Inventors: Yutaka Matayoshi, Yokosuka; Yasuhiko Nakagawa, Kamakura; Kyugo Hamai, Yokosuka; Shigeru Kamegaya, Tokyo, all of Japan

[73] Assignee: Nissan Motor Company, Ltd., Japan

[21] Appl. No.: 394,091

[22] Filed: Aug. 15, 1989

[30] Foreign Application Priority Data

| | | | |
|---|---|---|---|
| Aug. 16, 1988 | [JP] | Japan | 63-203521 |
| Aug. 16, 1988 | [JP] | Japan | 63-203522 |
| Aug. 16, 1988 | [JP] | Japan | 63-107763[U] |

[51] Int. Cl.[5] ..... F01L 1/30; F01L 1/18

[52] U.S. Cl. ..... 123/90.24; 123/90.39; 123/90.44; 123/90.46

[58] Field of Search ..... 123/90.24, 90.25, 90.39, 123/90.43, 90.44, 90.45, 90.46, 90.47

[56] References Cited

U.S. PATENT DOCUMENTS

| | | | |
|---|---|---|---|
| 2,751,895 | 6/1956 | Gassmann | 123/90.24 |
| 2,814,283 | 11/1957 | Gassmann et al. | 123/90.24 |
| 2,824,554 | 2/1958 | Sampietro | 123/90.28 |
| 2,831,470 | 4/1958 | Lorscheidt | 123/90.24 |
| 2,833,258 | 5/1958 | Lorscheidt et al. | 123/90.24 |
| 3,430,614 | 3/1969 | Meacham | 123/90.24 |
| 3,626,469 | 12/1971 | Ashley | 123/90.44 |
| 4,498,432 | 2/1985 | Hara et al. | 123/90.39 |
| 4,763,615 | 8/1988 | Frost | 123/90.47 |

FOREIGN PATENT DOCUMENTS

| | | |
|---|---|---|
| 2805350 | 8/1979 | Fed. Rep. of Germany . |
| 590149 | 6/1925 | France . |
| 1029745 | 6/1953 | France . |
| 53-51928 | 12/1978 | Japan . |
| 60-3412 | 1/1985 | Japan . |
| 60-32910 | 2/1985 | Japan . |
| 60-32911 | 2/1985 | Japan . |
| 61-6611 | 1/1986 | Japan . |
| 242960 | 4/1926 | United Kingdom . |
| 886151 | 1/1962 | United Kingdom . |

OTHER PUBLICATIONS

Patent Abstracts of Japan, vol. 10; No. 155, Jun. 4, 1986; Japanese Patent Application 61-11408.

*Primary Examiner*—Charles J. Myhre
*Assistant Examiner*—Weilun Lo
*Attorney, Agent, or Firm*—Lowe, Price, LeBlanc, Becker & Shur

[57] ABSTRACT

The first of a pair scissor like rocker arms is pivotally mounted at one end either by way of an adjust screw or a hydraulic lash adjuster and arangement to engage the top of a valve stem at the other. A cam follower which is located between the first and second ends engages a lift cam. The second of the rocker arms is pivotally mounted on the first one and has a closure cam follower at one end and engages the lower face of a retainer which secured to the top of the valve stem by way of a ring type collet. The shaft on which the second rocker arm is pivotally mounted can be provided with eccentric portions which enable the second rocker arm valve clearances to be adjusted separately from the adjustment of the first rocker arm clearance. The arrangement can be adapted to lift and close two valves.

10 Claims, 8 Drawing Sheets

ROCKER ARM ARRANGEMENT FOR INTERNAL COMBUSTION ENGINE POPPET VALVES AND THE LIKE

BACKGROUND OF THE INVENTION

1. Field of the Invention

The present invention relates generally to an internal combustion engine valve train and more specifically to a poppet valve control arrangement which features a pair of rocker arms which are arranged in a scissor-like manner and wherein one of the arms is used to lift the valve while the other is used to close the same.

2. Description of the Prior Art

Poppet valves used in internal combustion engines are usually biased to a closed position using a relatively strong spring and moved against the force of the spring by a cam, or a cam actuated rocker arm. However, with this type of arrangement a relatively large force is required to overcome the spring and lift the valve off its seat.

In order to overcome this drawback, it has been proposed to use a rocker arm arrangement which is basically comprised of a pair of rocker arms. These rocker arms are arranged in a manner which resembles a pair of scissors. One of the arms is used to lift the valve while the other is used to close the same.

Examples of such arrangements can be found in JU-A-61-6611, JP-A-60-32910, JP-A-60-39211, JU-B-53-51928 and JP-A-60-3412.

However, the arrangements disclosed in JP-A-60-3412, JP-A-60-32910 and JP-A-60-39211 for example, it is necessary to provide screw threads on the upper ends of the valve steps in order to enable the suitable retainer element to be connected thereto and to facilitate clearance adjustment to be carried out. The provision of the threads on the upper end portion of the valve stem weakens the same and invites the formation of fractures and the like which leads to breakages and/or similar malfunctions. In addition to this the number of parts which are required is increased and also increases the cost and the mass of the moving elements.

With the above type of arrangement, clearance settings must be carried out while the engine is cold and in a manner which anticipates the expansion which results from the engine warming up and which is therefore is a compromise which tends to provide excessive clearances during cold starts.

On the other hand, JU-A-61-6611 is such as to feature a simplified construction and the provision of a spring which tends to reduce the clearance between the closure arm and the lower face of retainer which is pinned to the upper end of the poppet valve stem. However, the clearance between the lift arm and the top of the valve stem is determined in accordance with the setting of a clearance adjust screw. Therefore, this arrangement also suffers from the hot/cold clearance compromise problem.

The arrangement disclosed in JU-B-53-51928 is such as to require two rocker arm support shafts, a retainer in which a spring is disposed and a clearance adjust screws on the arms which lift the valve. The clearance between the arms which close the valve are adjusted by mounting the arms on eccentric portions of the shaft on which they are pivotally supported and selectively rotating the shaft to a position wherein the clearance is set a desired value. Again the hot/cold clearance compromise problem is encountered while the need for two separate rocker arm shafts tends to increase the construction complexity and bulk of the cylinder head.

SUMMARY OF THE INVENTION

It is therefore an object of the present invention to provide a scissor type rocker arm type arrangement which is simple, and which features improved clearance adjustment arrangement.

It is a further object of the present invention to eliminate the need to provide screw threads on the upper end of the valve stem and to reduce the mass and complexity of the retainer which is provided thereon.

In brief, the above objects are achieved by an arrangement wherein the first of a pair scissor like rocker arms is pivotally mounted at one end either by way of an adjust screw or a hydraulic lash adjuster and arrangement to engage the top of a valve stem at the other. A cam follower which is located between the first and second ends engages a lift cam. The second of the rocker arms is pivotally mounted on the first one and has a closure cam follower at one end and engages the lower face of a retainer which secured to the top of the valve stem by way of a ring type collet. The shaft on which the second rocker arm is pivotally mounted can be provided with eccentric portions which enable the second rocker arm valve clearances to be adjusted separately from the adjustment of the first rocker arm clearance. The arrangement can be adapted to lift and close two valves.

More specifically, the present invention is deemed to comprise a rocker arm arrangement for use in an internal combustion engine having a cylinder head, a valve reciprocally disposed therein and a cam shaft on which first and second cams are disposed, the rocker arm arrangement featuring: a first rocker arm, the first rocker arm being pivotally mounted at a first end on a member which is supported on the cylinder head, the first rocker arm being arranged to engage the stem of the valve at a second end thereof and to have a first cam follower formed between the first and second ends, the first cam follower being arranged to engage the first cam on the cam shaft; and a second rocker arm, the second rocker arm being pivotally mounted on the first rocker arm, the second rocker arm having a second cam follower at a first end thereof and a portion which engages an engagement member which is provided on the top of the valve stem at a second end thereof, the second cam follower being arranged to engage the second cam formed on the cam shaft.

DETAILED DESCRIPTION OF THE PREFERRED EMBODIMENTS

Figure 1:
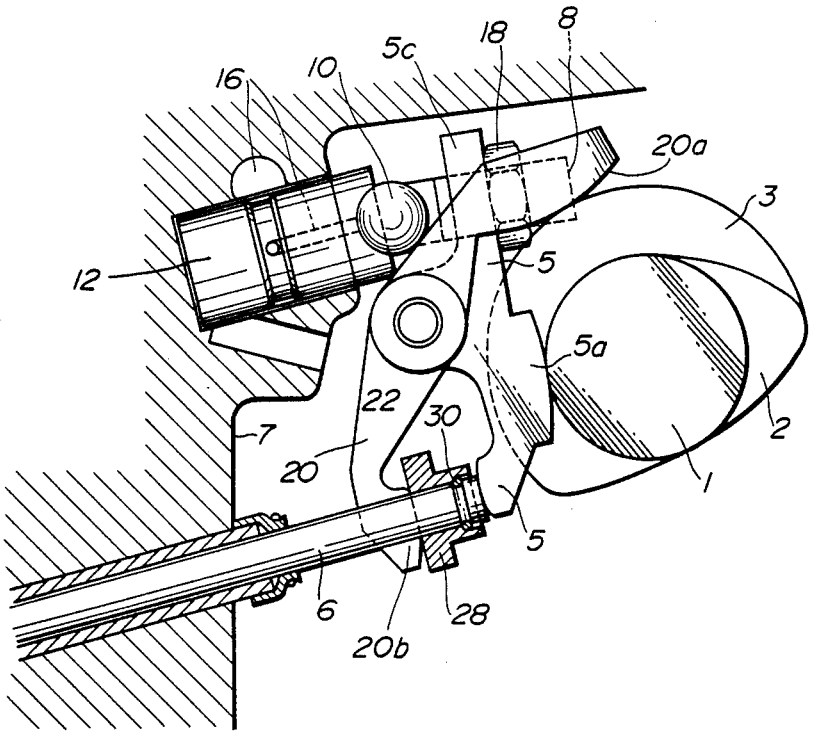
FIG. 1 is a side elevation, partially in section showing a first embodiment of the present invention.
Figure 2:
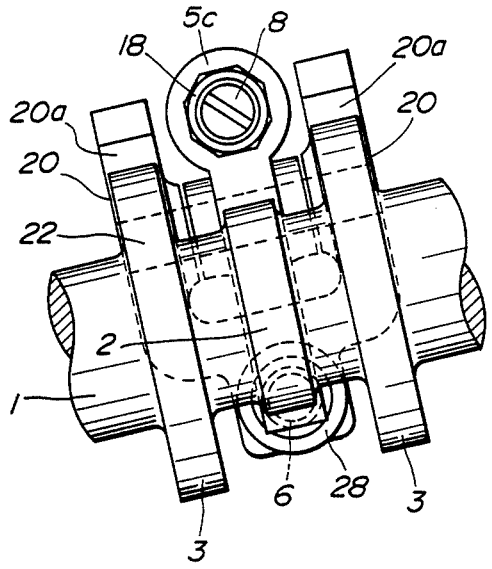
FIGS. 2 and 3 are plan views showing the first embodiment of the present invention as applied to single and dual valve arrangements, respectively.

FIGS. 1 and 2 show a first embodiment of the present invention. In this arrangement a cam shaft 1 is provided with a single lift cam 2 and two identical closure cams which are located on either side thereof. The lift cam 2 is arranged to cooperate with a cam follower 5*a* which is formed on a lift rocker arm 5. In this arrangement the lift rocker arm 5 has a first end 5*b* which which engages the top of a valve stem 6 and a second end 5*c* which is pivotally supported on the cylinder head 7. In this embodiment, the inboard end 5*c* (as it will be referred to hereinafter) of the lift rocker arm 5 is provided with an adjust screw 8 which has a ball or spherical member 10 formed at the lower end thereof. The ball 10 is arranged to seat in a spherical concavity formed in the top of cylindrical pivot 12 in a manner to define a universal joint or pivot.

As shown, the pivot 12 is received in a blind bore 12*a* defined in the cylinder head 7 and formed with a passage structure 16 which enables hydraulic fluid to be constantly supplied to the interface defined between the ball 10 and the concavity. A locknut 18 is provided on the adjust screw 8 to enable the screw to be securely locked in position following adjustment.

A closure rocker arm 20 is pivotally mounted on the lift rocker arm 5 by way of a pivot shaft 22. As shown, the closure rocker arm 20 is pivoted at essentially its mid point. Closure cam followers 20*a* are formed at the inboard ends of this rocker arm 20, which has a Y-shaped bifurcate configuration. The cam followers 20*a* are arranged to slidably engage the closure cams 3. The outboard end is provided with a curved portion 20*b* which engages the lower face of a retainer 28. In this arrangement the retainer 28 is retained on the valve stem 6 via the provision of a ring shaped collet 30 which is received in an annular groove which is formed proximate the upper end of the valve stem 6.

It will be noted that FIG. 1 has been drawn in a manner to facilitate a clear understanding of the rocker arm arrangement rather than in strict accordance with the plan view shown in FIG. 2.

The above described arrangement is such that adjustment of the adjust screw 8 produces a reaction with the pivot 12 which enables cam followers 5*a*, 20*a* formed on the lift and closure rocker arms to be moved toward or away from their respective cams 2, 3 in a manner which permits suitable valve clearances to be obtained. As will be appreciated, due to the scissor like configuration of the two rocker arms 5, 20, in the event that the lock nut 18 is released and the adjust screw is rotated in a direction which increases the distance between the ball member 10 and the inboard end of the rocker arm 5, the cam follower 5*a* is moved against the lift cam 2 and the reaction thus produced, forces the outboard end 5*b* of the lift rocker arm 5 down toward the top of the valve stem 6. This movement of the lift rocker arm due to the rotation of the adjust screw also moves the cam follower 20*a* formed on the inboard end of the closure rocker arm 20. However, due to the contour of the closure cam 3 this produces little change in the location of the outboard end 20*b*. The net effect is that the retainer 28 tends to be sandwiched between the outboard ends of the two rocker arms in a manner which reducess the clearances.

Figure 3:
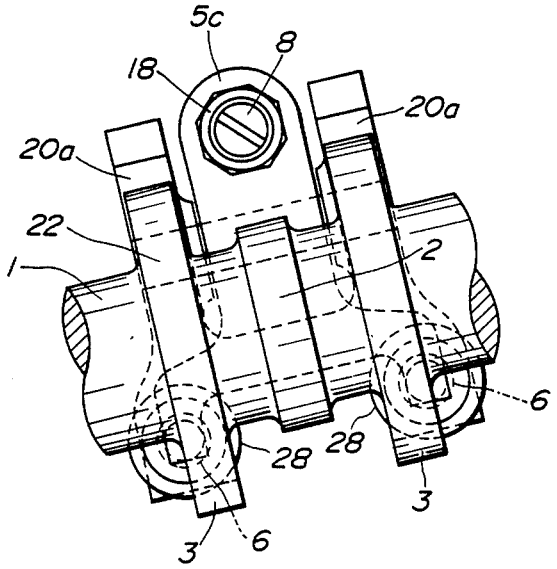

As shown in FIG. 3 the invention is not limited to single valve arrangements and can be applied to arrangements wherein two or more valves are opened and closed simultaneously. In this instance, the lift rocker arm has a Y shaped bifurcate configuration while the closure arm has an essentially H-shaped configuration (see FIGS. 14 and 17 by way of example).

The lift and closure rocker arms have two outboard ends each, Viz., 5*b*, 5*b*′ 20*b* and 20*b*′. As the arrangement and operation of this variant will be immediately obvious to those skilled in the art, no further disclosure will be given for brevity.

Figure 4:
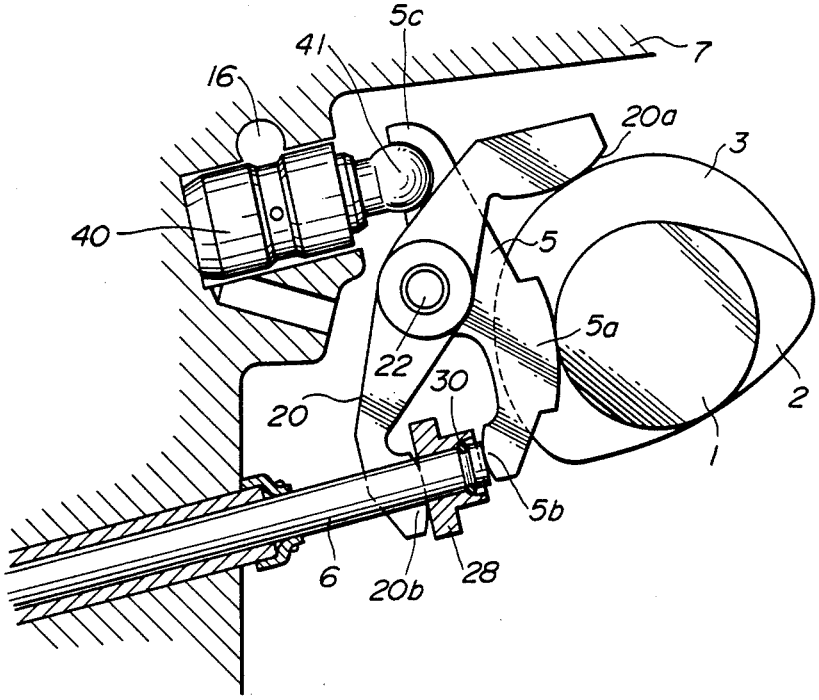
FIGS. 4 and 5 are side elevation and plan views showing an arrangement according to a second embodiment of the present invention.
Figure 5:
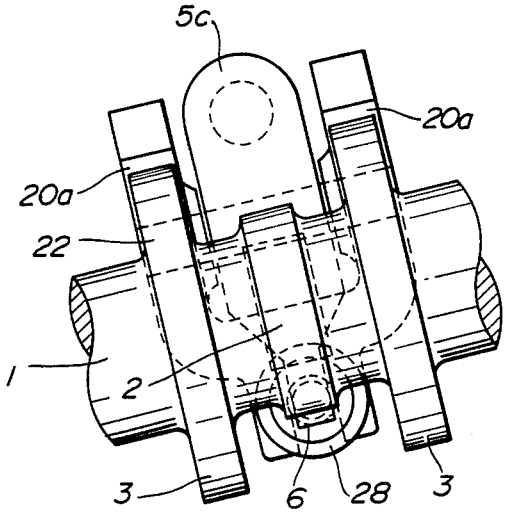

FIGS. 4 and 5 show a second embodiment of the present invention. In this arrangement, the pivot and adjust screw combination are replaced with a hydraulic lash adjuster 40. In this instance the inboard end 5*c* of the lift rocker arm 5 is formed with spherical concavity which receives a ball 41 which is provided at the top of the lash adjuster 40. Under the influence of the lash adjuster 40, the cam followers 5*a*, 20*a* are biased into engagement with their respective cams and therefore produce reactions which tend to close the scissor like arrangement and thus move the outboard ends 5*b*, 20*b* of the rocker arms 5, 20 toward each other. This of course tends to reduce the clearances between the valve stem 6, and retainer 28 and the respective rocker arms 5, 20 to zero. Due to the resiliency of the lash adjuster, it is possible to maintain essentially zero clearances under all modes of engine operation.

Figure 6:
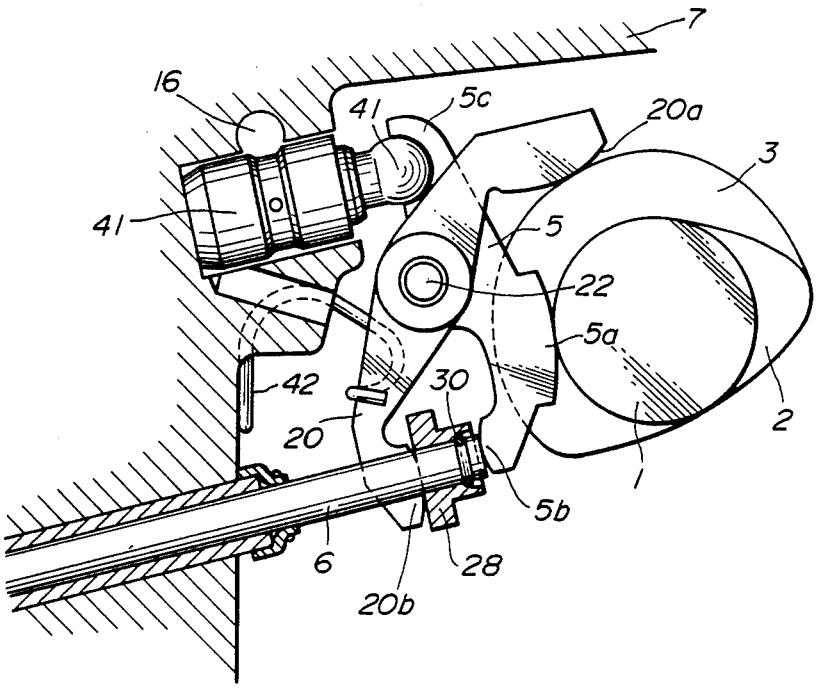
FIGS. 6 and 7 are side elevation and plan views showing an arrangement according to a third embodiment of the present invention.
Figure 7:
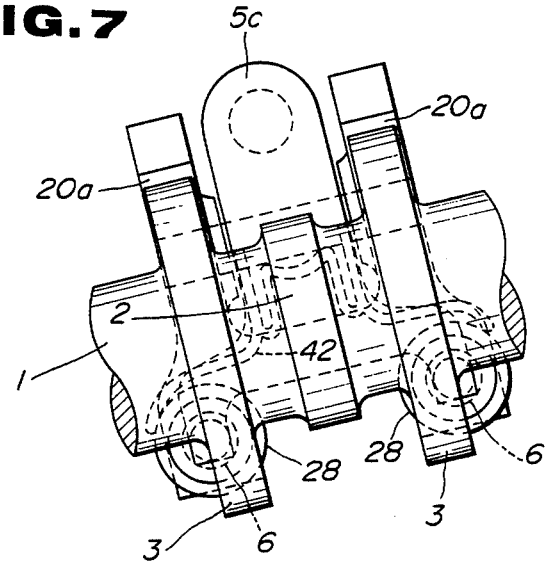

FIGS. 6 and 7 show a third embodiment of the present invention. This embodiment is essentially the same as the second and differs in that a spring 42 is provided between the closure rocker arm 20 aand the cylinder head 7. This spring 42 is arranged to bias the outboard end of the closure rocker arm 20 toward engagement with the lower face of the retainer 28 in a manner which reduces the clearance therebetween. The bias produced by the spring 32 also tends to move the valve stem 6 in a direction which closes the valve and which improves the sealing in the case that excessive clearances tend to develop over a period of time.

Figure 8:
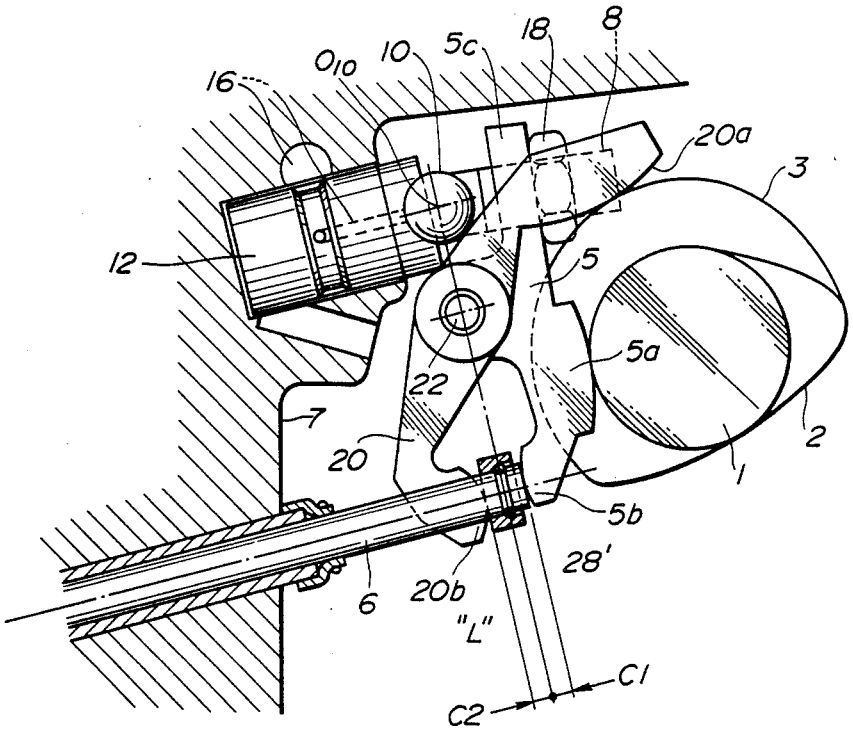
FIG. 8 is a side elevation showing an arrangement according to a fourth embodiment of the present invention.
Figure 9:
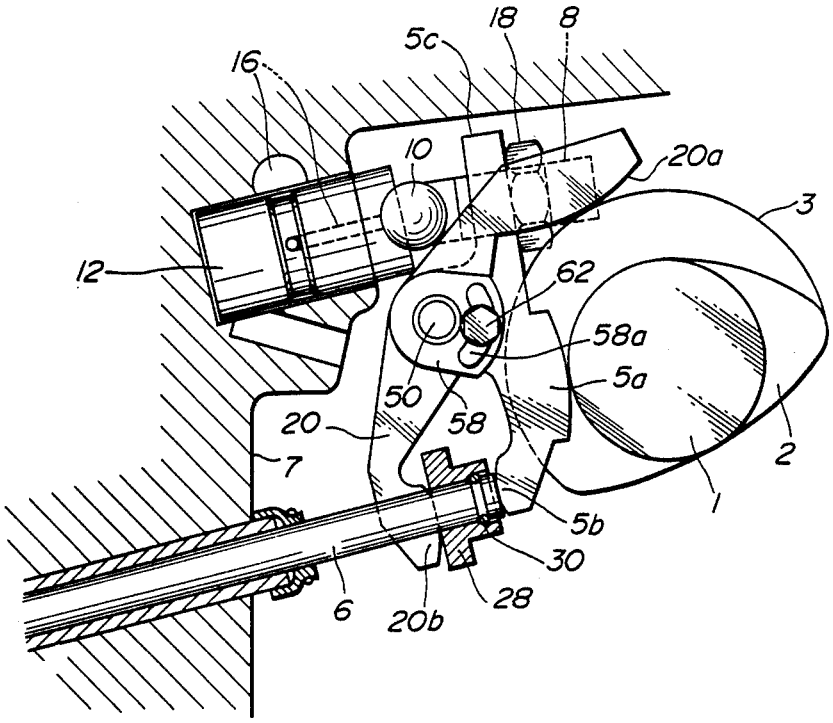
FIGS. 9–13 show the construction and arrangement of a fifth embodiment of the present invention.
Figure 10:
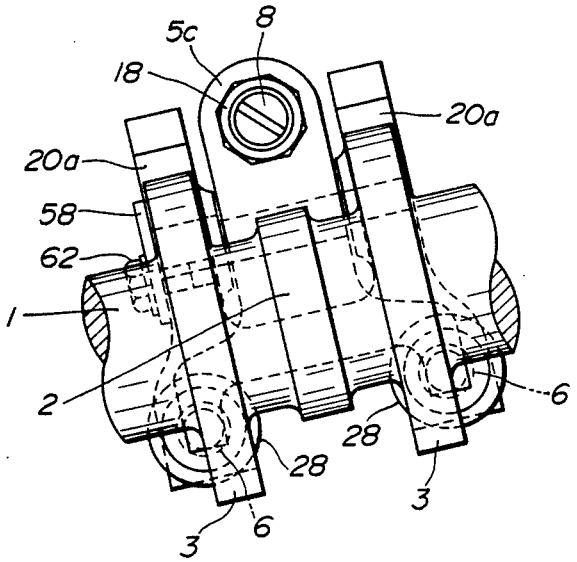

FIGS. 8 and 9 show a fourth embodiment of the present invention. This embodiment is essentially similar to the first one and features the arrangement wherein the center $O_{10}$ of the ball 10 formed at the end of the adjust screw; the axis of the shaft 22 on which the closure rocker arm is pivotally mounted on the lift arm; and a portion of the valve stem 6 which is located essentially halfway between the top of the valve stem and the lower face of a specially configured retainer; are all aligned along a line L when the valve is in closed position.

In this embodiment the retainer 28′ is relative small and is dimensioned so that the distance C1 defined between the top of the valve stem 6 and the line L and the distance C2 which is defined between the line L and the lower face of the retainer 28′ are approximately equal. It will be noted that as the retainers used in the present invention are secured in place by the ring type collect 30, the size can be reduced to the degree illustrated in FIG. 8.

With this arrangement, the lift rocker arm 5 engages the top of the valve stem 6 in a manner whereby the moment which tends to bend the stem 6 is reduced considerably. Further, the spacing between the outboard ends of the rocker arms 5, 20 (C1+C2) is such as reduce the clearances between the valve stem end and the lower face of the retainer 28'.

During the period the valve tends to be subject to the maximum acceleration the lift rocker arm 4 tends to engage the top of the valve stem 6 in a manner which tends to apply a force directly along the axis of the stem and thus minimize the tendency to bend the stem as mentioned above. As the two distances C1 and C2 are essentially the same, the variation between the two clearances tends to be minimized and smooth valve operation.

In view of the expansion which occurs as the engine warms up, it is necessary to set the thickness dimension of the retainer very carefully. However, as noted above the construction which enables the same to be secured in place by the ring type collect facilitates a relative small construction.

By rotating the adjust screw 8 it is possible to adjust the position of the point about which the lift rocker arm 5 pivots and to adjust the valve clearance between the outboard end **5*b* of the arm and the top of the valve stem 6**.

FIGS. 9 to 13 show a fifth embodiment of the present invention. This embodiment features a basic construction which is essentially similar to the first one and which is characterized by an arrangement which enables the clearance of the closure rocker arm 20 to be adjusted with respect to the lift rocker arm 5.

Figure 11:
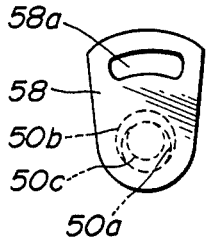
Figure 12:
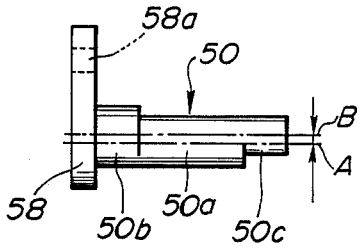
Figure 13:
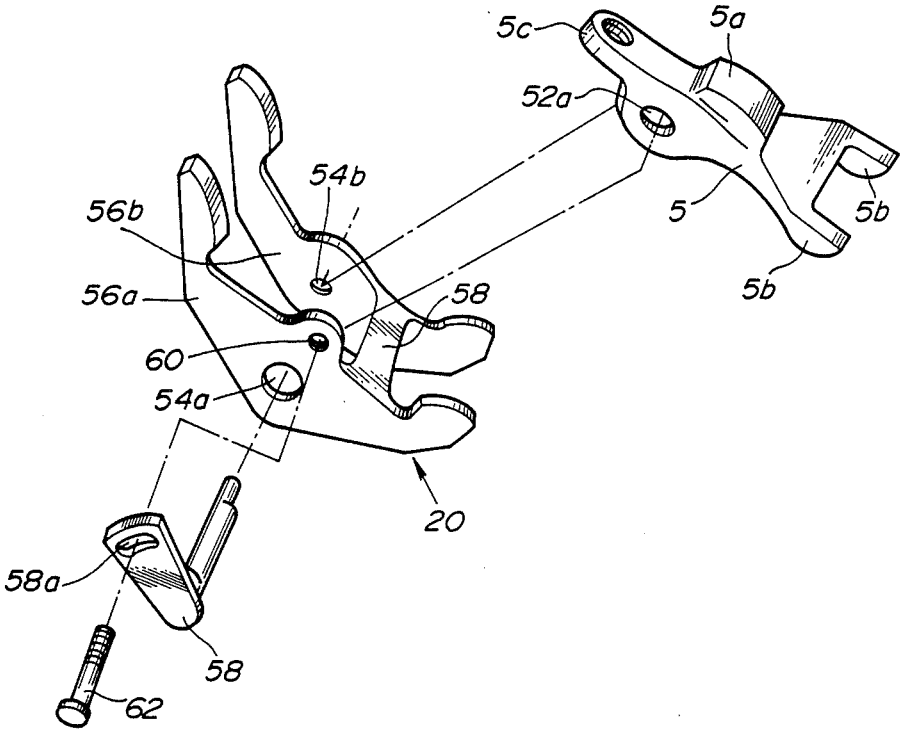

As shown in FIGS. 11 to 13, the shaft 50 on which the closure rocker arm is pivoted, is formed with a portion **50*a* which is received in a bore 52*a* formed in the lift rocker arm 5, and portions 50*b* and 50*c* which are concentric with respect to one another and which are eccentric with respect to portion 50*a*. In this arrangement portion 50*a*** is arranged to be concentric with respect to a first axis A while portions are arranged to be concentric with respect to a second axis B. The axes A and B are offset with respect to each other by a predetermined distance S.

Shaft portions **50*b* and 50*c* are arranged to be received in concentrically arranged bores 54*a*, 54*b* formed in the arms 56*a*, 56*b* of an essentially H-shaped closure rocker arm 20. Viz., in this arrangement the closure rocker arm is formed with two parallel arms each of which have cam followers and retainer engaging portions. As will be appreciated from FIG. 11** the instant embodiment is adapted to open two valves simultaneously and the retainer engaging portions are arranged to engage different retainers.

An integral web-like bridge member 58 spans between the two parallel arms **56*a*, 56*b*** at a level located between the axis about which the arms are pivotally and the outboard ends of the same.

One end of the shaft 50 is provided with a sector-shaped portion 58 which extends normally to the axes A, B. An arcuate grooves **58*a* is formed in the sector-shaped portion. The arm 56*a* which is located immediately adjacent the sector-shaped portion 56 is formed with a threaded bore 60. A bolt 62 is passed through the arcuate groove 58*a* and is threadedly received in the bore 60**.

With the above arrangement it is possible to release the bolt and rotate the shaft. Due to the eccentricity of portion **50*a* with respect to portions 50*b* & 50*c*, this rotation varies the clearance between the outboard ends of the rocker arms 56*a*, 56*b*** and the lower faces of the corresponding retainers.

Accordingly, by firstly adjusting the lift rocker arm clearance using the adjust screw 8, it is then possible to adjust the closure rocker arm clearance by rotating the shaft 50. When a suitable adjustment is achieved, the bolt 62 can be tightened to lock the shaft 50 in the selected position.

Figure 14:
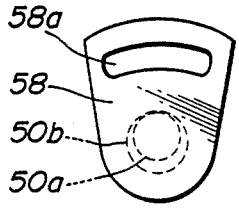
FIGS. 14 to 16 are views showing the construction which characterizes a sixth embodiment of the present invention.
Figure 15:
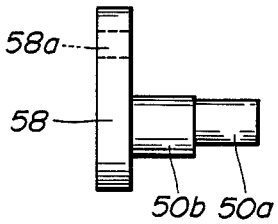
Figure 16:
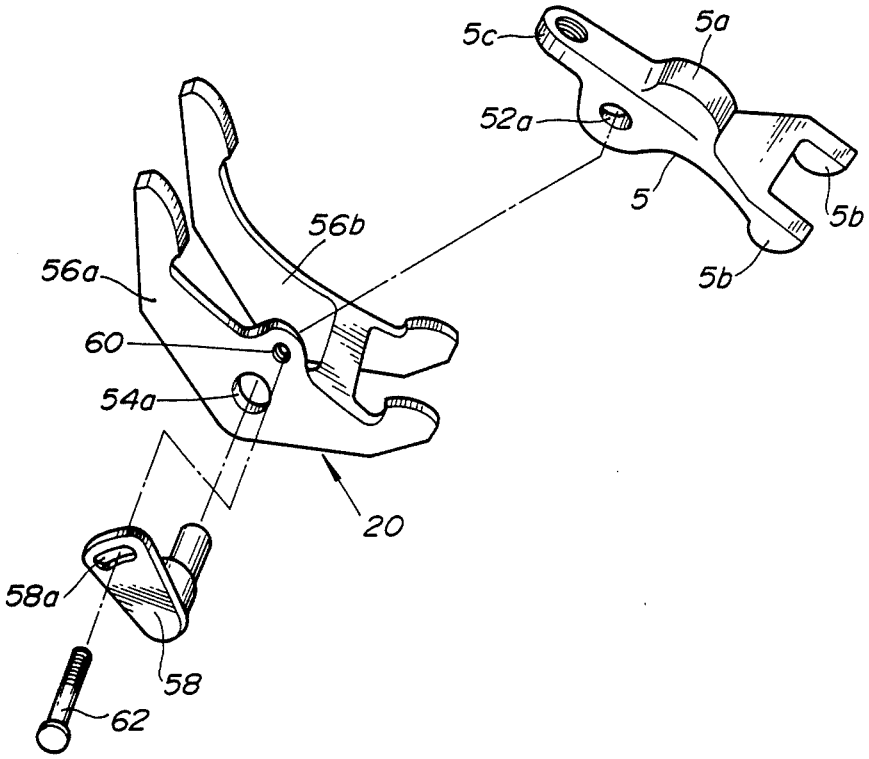

FIGS. 14 to 16 show a sixth embodiment of the present invention. As will be apparent from the drawings, this embodiment is variant of the fifth one and is such that the aperture formed in the arm and the eccentric portion on the pivot shaft have been omitted for constructional simplification.

What is claimed is:

1. In an internal combustion engine having a cylinder head, a valve reciprocally disposed therein and a cam shaft on which first and second cams are disposed, a rocker arm arrangement comprising:

a first rocker arm, said first rocker arm being pivotally mounted at a first end on a member which is supported on said cylinder head, said first rocker arm being arranged to engage the stem of said valve at a second end thereof and to have a first cam follower formed between said first and second ends, said first cam follower being arranged to engage the first cam of said cam shaft; and a second rocker arm, said second rocker arm being pivotally mounted on said first rocker arm, said second rocker arm having a second cam follower at a first end thereof and a portion which engages an engagement member which is provided on the top of said valve stem at a second end thereof, said second cam follower being arranged to engage the second cam formed on said cam shaft.

2. A rocker arm arrangement as claimed in claim 1 wherein said first rocker arm is pivotally mounted on a universal pivot, said universal pivot being defined between a first member supported on said cylinder head and a second member provided on the first end of said first rocker arm.

3. A rocker arm arrangement as claimed in claim 2 wherein said second member is formed on one end of an adjust screw which is threadedly received in a threaded bore formed in said first end of said first rocker arm.

4. A rocker arm arrangement as claimed in claim 2 wherein said first member is a hydraulic lash adjuster.

5. A rocker arm arrangement as claimed in claim 1 wherein said first and second rocker arms are pivotally mounted on a shaft, the portion on which said first rocker arm is supported being eccentric with respect to the portion of the shaft on which said second rocker arm is supported, said shaft being selectively rotatable in a manner to vary the relative positional relationship between said first and second rocker arms.

6. A rocker arm arrangement as claimed in claim 1 wherein one of said first and second rocker arms has a Y-shaped configuration.

7. A rocker arm arrangement as claimed in claim 1 wherein one of said first and second rocker arms has a H-shaped configuration.

8. A rocker arm arrangement as claimed in claim 1 wherein said first and second rocker arms are adapted to operate first and second valves.

9. A rocker arm arrangement as claimed in claim 1 wherein said engagement member comprises a retainer, said retainer being secured to the stem of said valve by a ring type collet.

10. A rocker arm arrangement as claimed in claim 9 wherein:

the point about which the first end of said first rocker arm is pivotal, the axis about which said second rocker arm is pivotal, and a point which is located essentially mid-way between the second ends of said first and second rocker arms, are essentially aligned with one another.

* * * * *